US011353270B1

(12) United States Patent
Fritch et al.

(10) Patent No.: US 11,353,270 B1
(45) Date of Patent: Jun. 7, 2022

(54) HEAT PIPES DISPOSED IN OVERLAPPING AND NONOVERLAPPING ARRANGEMENTS

(71) Applicant: ADVANCED COOLING TECHNOLOGIES, INC., Lancaster, PA (US)

(72) Inventors: Daniel Fritch, Harvest, AL (US); Jared Tower, San Diego, CA (US); Jens Weyant, Lititz, PA (US); William G Anderson, Bound Brook, NJ (US)

(73) Assignee: ADVANCED COOLING TECHNOLOGIES, INC., Lancaster, PA (US)

( * ) Notice: Subject to any disclaimer, the term of this patent is extended or adjusted under 35 U.S.C. 154(b) by 183 days.

(21) Appl. No.: 16/668,096

(22) Filed: Oct. 30, 2019

Related U.S. Application Data

(60) Provisional application No. 62/829,257, filed on Apr. 4, 2019.

(51) Int. Cl.
*F28D 15/00* (2006.01)
*F28D 15/04* (2006.01)
*F28D 15/02* (2006.01)

(52) U.S. Cl.
CPC ..... *F28D 15/046* (2013.01); *F28D 15/0275* (2013.01); *F28D 2015/0216* (2013.01)

(58) Field of Classification Search
CPC ..... F28D 15/046; F28D 15/0275; F28D 2015/0216
USPC ..... 165/104.26
See application file for complete search history.

(56) References Cited

U.S. PATENT DOCUMENTS 1,799,081 A * 3/1931 Blomqvist ..... F28B 1/02 165/169
3,477,412 A * 11/1969 Kitrilakis ..... F22B 35/10 165/104.19
3,896,992 A * 7/1975 Borovina ..... F24D 19/1069 237/19
4,158,438 A * 6/1979 Hapgood ..... F24H 1/165 237/7
4,401,261 A * 8/1983 Brown ..... F28D 21/0007 237/19
4,426,037 A * 1/1984 Bernstein ..... F24H 1/287 122/18.4
5,131,351 A * 7/1992 Farina ..... F28F 1/36 122/18.4
5,687,678 A * 11/1997 Suchomel ..... F28D 7/024 122/249
5,806,585 A * 9/1998 Yoshida ..... F28D 1/05316 165/171
6,026,801 A * 2/2000 Barkan ..... F24H 1/43 122/406.1
7,000,684 B2 * 2/2006 Kenny ..... F04B 19/006 174/15.1

(Continued)

*Primary Examiner* — Claire E Rojohn, III
(74) *Attorney, Agent, or Firm* — McNees Wallace & Nurick

(57) ABSTRACT

An apparatus for dissipating thermal energy including a baseplate including a first body having a first groove and a second groove intersecting one another, the first groove and the second groove formed in and only accessible from a first side of the baseplate. The apparatus including a first heat pipe and a second heat pipe arranged and disposed to provide both an overlapping arrangement and a nonoverlapping arrangement within the first groove and the second groove of the baseplate.

20 Claims, 11 Drawing Sheets

(56) References Cited

U.S. PATENT DOCUMENTS 7,523,721 B2 * 4/2009 Hamada ..... F24H 1/52 122/31.1
7,562,696 B2 7/2009 Lin et al.
7,891,414 B2 * 2/2011 Cheng ..... F28D 15/0233 165/104.33
9,109,844 B2 * 8/2015 Williams ..... F28F 1/26
9,353,967 B2 * 5/2016 Ahmady ..... F28D 7/00
D767,107 S * 9/2016 Stephens ..... D23/323
D805,616 S * 12/2017 Kim ..... D23/323
9,915,450 B2 * 3/2018 Seggerman ..... F24D 11/0257
10,012,413 B2 * 7/2018 Li ..... F24H 9/0026
10,495,343 B2 * 12/2019 Jacques ..... F24H 1/43
10,571,135 B2 * 2/2020 Kreutzman ..... F24D 19/1048
10,575,434 B2 * 2/2020 Van Vliet ..... F24H 9/20
10,724,762 B2 * 7/2020 Deivasigamani ..... F24H 9/1836
10,753,644 B2 * 8/2020 Niu ..... F24H 9/146
11,162,710 B2 * 11/2021 Deivasigamani ..... F24H 1/43
2004/0007879 A1 * 1/2004 Ruggieri ..... F22B 21/26 290/52
2005/0133202 A1 * 6/2005 Jorgensen ..... F28F 27/02 165/103
2006/0005955 A1 * 1/2006 Orr ..... F28D 7/024 165/108
2006/0016401 A1 * 1/2006 Loving ..... F23C 6/04 237/19
2006/0213223 A1 * 9/2006 Wilding ..... F28D 7/0066 62/613
2007/0056713 A1 3/2007 Chiriac et al.
2007/0127209 A1 * 6/2007 Lopatinsky ..... H01L 23/427 361/700
2007/0143914 A1 * 6/2007 Shirai ..... F24H 1/102 4/420.2
2008/0022947 A1 * 1/2008 Zorzit ..... F22B 21/346 122/235.11
2009/0120616 A1 * 5/2009 Jimenez ..... F28F 17/005 165/104.19
2009/0151574 A1 * 6/2009 Nijboer ..... A47J 31/40 222/129.4
2009/0151899 A1 6/2009 Chang
2010/0101767 A1 * 4/2010 Furui ..... F28D 20/0034 165/163
2010/0126432 A1 * 5/2010 Eberle ..... F28D 7/024 122/20 B
2011/0041781 A1 * 2/2011 Deivasigamani ..... F24H 1/165 165/184
2011/0155366 A1 * 6/2011 Brunn ..... F28D 7/024 165/200
2011/0308259 A1 * 12/2011 Wray ..... G05D 23/192 165/104.11
2012/0160456 A1 6/2012 Aoki
2012/0266592 A1 * 10/2012 Foy ..... F02M 25/12 60/599
2012/0312508 A1 12/2012 Shen
2014/0182817 A1 * 7/2014 Yu ..... F28D 15/0275 165/104.21
2014/0233174 A1 * 8/2014 Demange ..... H05K 7/20218 361/679.47
2015/0064077 A1 * 3/2015 McSpadden ..... B01J 19/0053 422/198
2015/0096505 A1 * 4/2015 Deivasigamani ... F24D 17/0078 122/18.4
2015/0204550 A1 * 7/2015 Deivasigamani ..... F24H 1/48 237/19
2015/0369085 A1 * 12/2015 Kosuda ..... F22B 37/103 60/661
2016/0040556 A1 * 2/2016 Hikichi ..... F01K 25/08 122/18.4
2016/0169071 A1 * 6/2016 Deivasigamani ..... F01N 3/043 60/39.5
2016/0338231 A1 * 11/2016 Prado ..... F28F 3/10
2018/0094832 A1 * 4/2018 Kiely ..... F24H 1/22
2018/0187980 A1 * 7/2018 Gil ..... F28D 7/024
2018/0245855 A1 * 8/2018 Deivasigamani ..... F28F 1/12
2018/0283797 A1 10/2018 Tochigi et al.
2019/0293355 A1 * 9/2019 Ko ..... F28F 21/084
2020/0224941 A1 * 7/2020 Cocuzza ..... F28D 7/024
2021/0041184 A1 * 2/2021 van Noesel ..... F28F 1/40

* cited by examiner 10.5°C Temperature Rise, 10°C Predicted by Analysis

12°C Temperature Rise, 14°C Predicted by Analysis

HEAT PIPES DISPOSED IN OVERLAPPING AND NONOVERLAPPING ARRANGEMENTS

FIELD OF THE INVENTION

The present invention is directed to heat pipes, and more particularly, to apparatus utilizing heat pipes.

BACKGROUND OF THE INVENTION

Integrating heat pipes into heat spreaders has become a well-established practice to significantly reduce thermal gradients from high power electronics to their eventual heat sinks. However; heat pipes can have geometric limitations which can limit their efficacy. Additionally, heat pipe capillary pumping capacity can be significantly reduced when operating in a scenario with high acceleration if a component of the acceleration opposes the direction liquid is pumped back to the heat pipe evaporator. In order to maximize the effectiveness of some heat spreaders, it would be useful to have heat pipes overlap and run orthogonally to one another in order to spread heat in multiple directions, as well as to have some heat pipes operating while others cannot under high acceleration loading conditions.

One solution to combat these issues has been to embed heat pipes in opposite sides (i.e., from both sides) of a heat spreader, such as a spreader plate using adhesives or solder alloys with different melting temperatures, the solder alloy associated with embedding a first installed heat pipe having a higher melting temperature than the solder alloy associated with embedding a second installed heat pipe, so that the solder alloy associated with embedding the first installed heat pipe does not melt during installation of the second heat pipe. For many heat spreaders, this manufacturing method may not be possible because critical features are machined into one side of a heat spreader to make intimate or conformal contact with components. This manufacturing method also introduces more time, cost, and risk to the parts.

Embedding heat pipes in a single orientation or direction will greatly increase the effective thermal conductivity in that direction. For example, aluminum has a thermal conductivity of roughly 200 W/m K in all directions. Embedding heat pipes in one orientation or direction can increase the effective thermal conductivity in that direction to between 600 and 2500 W/m K, depending on the length of the embedded heat pipes. The weight of the plate with embedded heat pipes is only a few percent more than the weight of the aluminum, while increasing the effective thermal conductivity up to an order of magnitude or more.

A vapor chamber is a planar heat pipe, which can effectively spread heat in a plane in two directions. Although vapor chambers have an effective thermal conductivity that is 10 to 100 times higher compared to a plate with embedded heat pipes, vapor chambers are roughly 2.3 times the density of a plate with embedded heat pipes. In addition to the increase in density, a further drawback of vapor chambers is that vapor chambers are much more costly to manufacture than plates with embedded heat pipes.

There is a need for heat pipe-embedding structures that have effective thermal conductivities approaching those of vapor chambers without suffering from the drawbacks of vapor chambers.

SUMMARY OF THE INVENTION

Applicant has found that by arranging and disposing two layers of heat pipes of an embedded heat pipe system at an angle to each other, the effective thermal conductivity of the embedded heat pipe system can be improved in a plane, similar to a vapor chamber, while reducing the fabrication costs and weight compared with the vapor chamber. The proposed solution improves upon the above-mentioned process and/or arrangement or configuration by allowing for integration of overlapping heat pipes in one side (i.e., from one side) of the heat spreader. This solution reduces the integration process to a single step, (compared with two separate steps; each step associated with embedding heat pipes in one side of opposed sides of a heat spreader), and allows for freedom to add critical machined features on the side contacting heat dissipating components.

In one embodiment, an apparatus for dissipating thermal energy including a baseplate including a first body having a first groove and a second groove intersecting one another, the first groove and the second groove formed in and only accessible from a first side of the baseplate. The apparatus including a first heat pipe and a second heat pipe arranged and disposed to provide both an overlapping arrangement and a nonoverlapping arrangement within the first groove and the second groove of the baseplate.

In another embodiment, a method of making an apparatus for dissipating thermal energy including providing a baseplate including a first body and forming a first groove and a second groove in a first side of the baseplate, the first groove and the second groove intersecting one another, and the first groove and the second groove only being accessible from the first side of the baseplate. The method further including positioning a first heat pipe and a second heat pipe to provide both an overlapping arrangement and a nonoverlapping arrangement within the first groove and the second groove of the baseplate.

In yet another embodiment, an apparatus for dissipating thermal energy including a baseplate including a body having a first groove and a noncoincident second groove each intersecting a third groove, the first groove, the second groove, and the third groove each formed in and only accessible from a first side of the baseplate. The apparatus further including a first heat pipe at least partially disposed in the first groove, a second heat pipe at least partially disposed in the second groove, and a third heat pipe at least partially disposed in the third groove, the first heat pipe, the second heat pipe and the third heat pipe each arranged and disposed to provide both an overlapping arrangement and a nonoverlapping arrangement within at least one of the first groove, the second groove, and the third groove of the baseplate.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
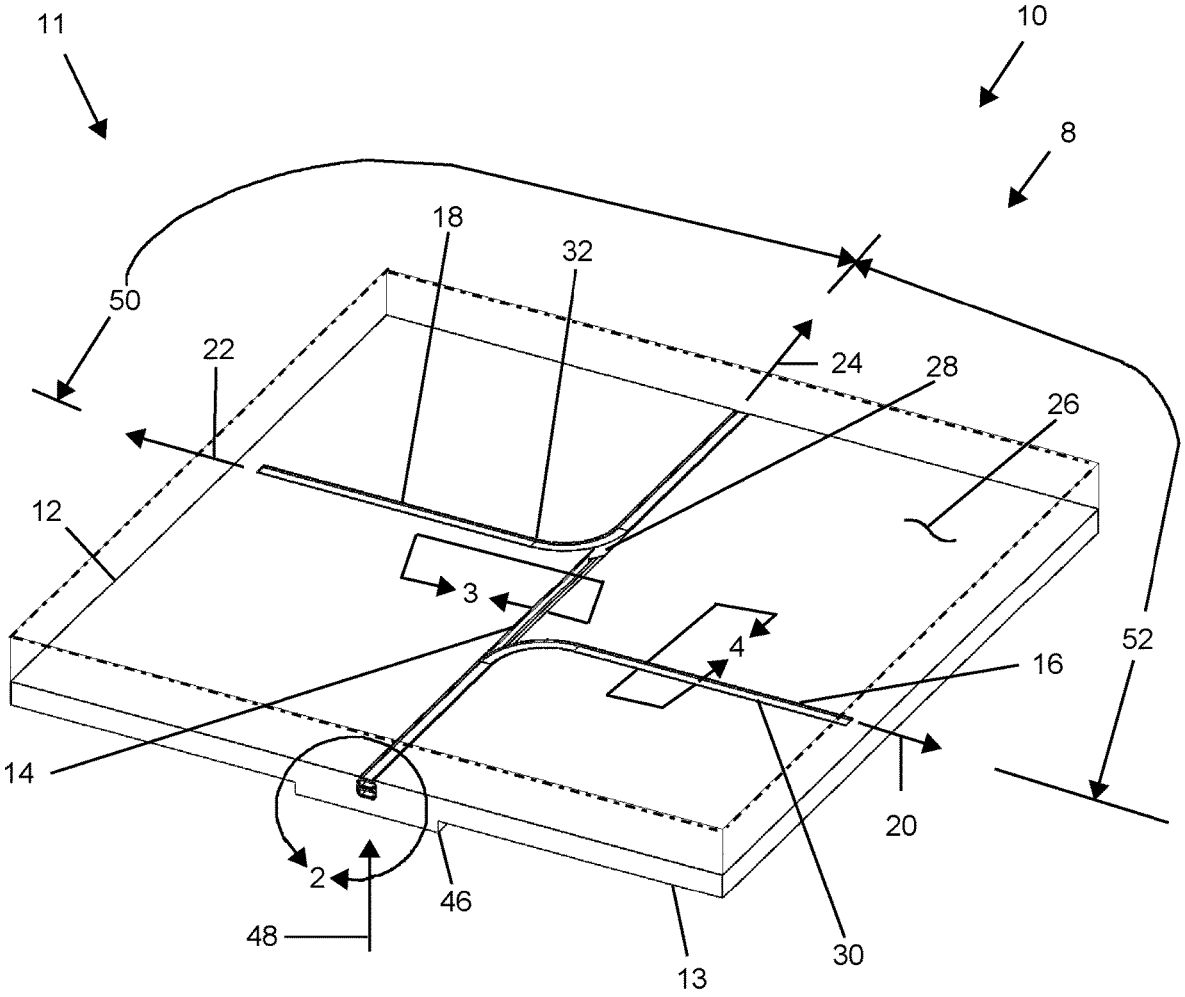
FIG. 1 is a perspective view of an exemplary heat spreader.

FIG. 1 shows heat pipes 14, 16, 18 are arranged in orientations allowing for the most efficient spreading of heat of baseplate 12 of an apparatus 8 for dissipating thermal energy such as a heat spreader 10 or heat sink 11 while allowing for acceleration loading in any direction. As shown, this arrangement of heat pipes 14, 16, 18 would allow for heat spreading in directions 20, 22 which are orthogonal directions relative to direction 24 of the main straight heat pipe 14 in normal conditions. That is, directions 20, 22 correspond to the condenser or evaporator portions of respective embedded heat pipes 16, 18 versus the direction 24 of evaporator portion of embedded heat pipe 14. Direction 24 subtends an angle 50 with direction 22, and direction 24 subtends an angle 52 with direction 20. This arrangement also allows for heat of baseplate 12 to be transferred during some acceleration loading scenarios which may cause one of the bent pipes to stop functioning. In one embodiment, the direction of one or more of the heat pipe grooves may extend in other orientations that are neither coincident with nor perpendicular to other heat pipe grooves (i.e., other acute/obtuse angle orientations). That is, for example, one or both of angles 50, 52 may be less than 90 degrees, 90 degrees or less, or greater than 90 degrees. In one embodiment, one or more of the heat pipe grooves partially or entirely extending in a curved path, such as a shape similar to a parenthesis is contemplated by the present invention.

In one embodiment, apparatus 8 acts as heat spreader 10, in which, for example, the edges of baseplate 12 are water cooled. In one embodiment, apparatus 8 acts as heat sink 11, in which, for example, fins (not shown) or other heat removal feature or component are utilized. In one embodiment apparatus 8 acts as both heat spreader 10 and heat sink 11. In one embodiment, one or more portions of apparatus 8 act as either or both heat spreader 10 and heat sink 11, depending upon the application. The apparatus of the present invention contemplates any number of variations and/or combinations of heat spreaders and/or heat sinks.

Figure 2:
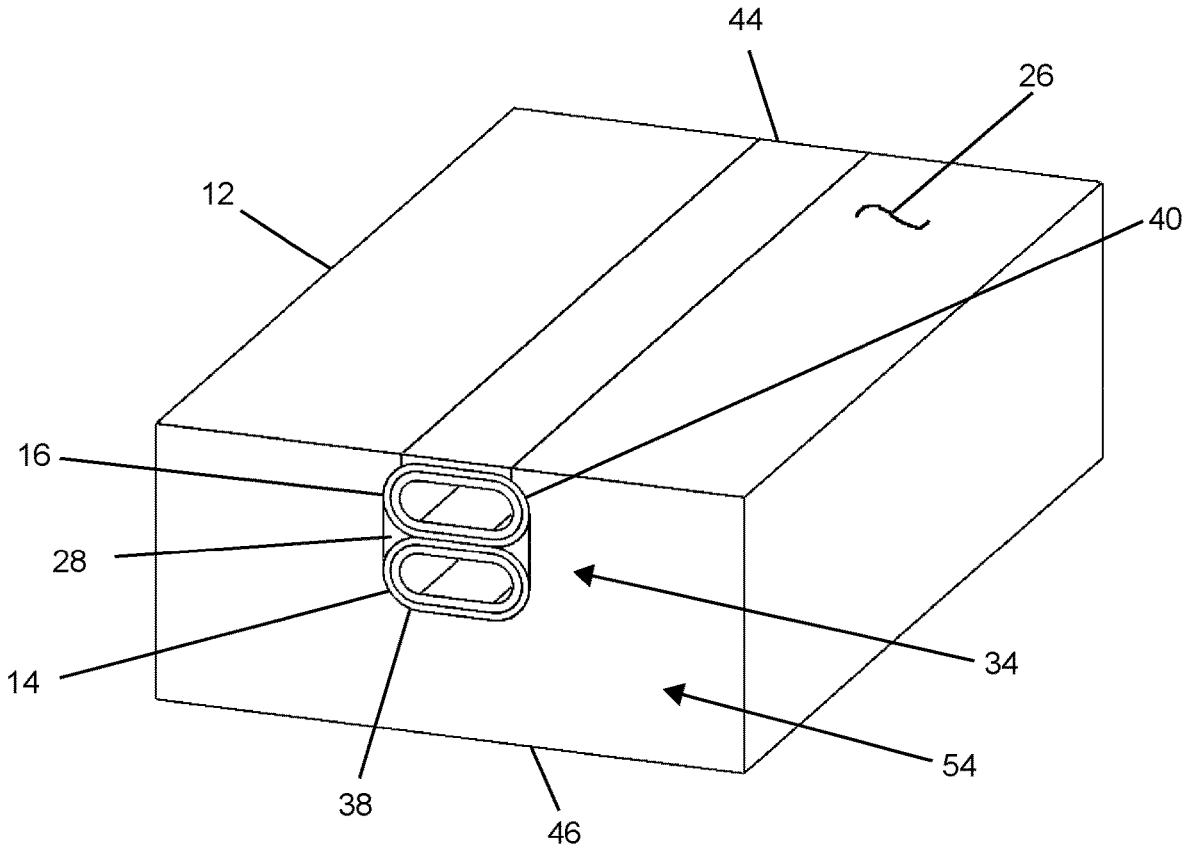
FIG. 2 is taken from region 2 of the heat spreader of FIG. 1.

As shown in FIGS. 1 and 2, heat pipes 14, 16, 18 are installed into baseplate 12 from a single side or surface 26. That is, capture groove or groove 28 which is formed in surface 26 of a body 13 of baseplate 12, and is only accessible from surface 26, is adapted to receive heat pipe 14 and a portion of heat pipes 16, 18. Capture groove or groove 30 which is formed in surface 26 of baseplate 12, and is only accessible from surface 26, is adapted to receive the remaining portion of heat pipe 16 not received by groove 28, and capture groove or groove 32 which is formed in surface 26 of baseplate 12, and is only accessible from surface 26, is adapted to receive the remaining portion of heat pipe 18 not received by groove 28. That is, groove 28 intersects grooves 30, 32. As further shown in FIG. 2, baseplate 12 includes a surface 46 opposite surface 26 that is adapted to receive heat input 48 from a heat source (not shown) such as electronic components. In one embodiment, surface 46 may be adapted to achieve intimate or conformal contact with the heat source. As shown, surface 46 has a footprint that is generally aligned with and encompasses groove 28, the footprint also encompassing a portion of grooves 30, 32 extending away from their junction or intersection with groove 28. In one embodiment, the surface footprint may encompass any portion of the groove(s) in which one or more heat pipes are embedded.

Figure 3:
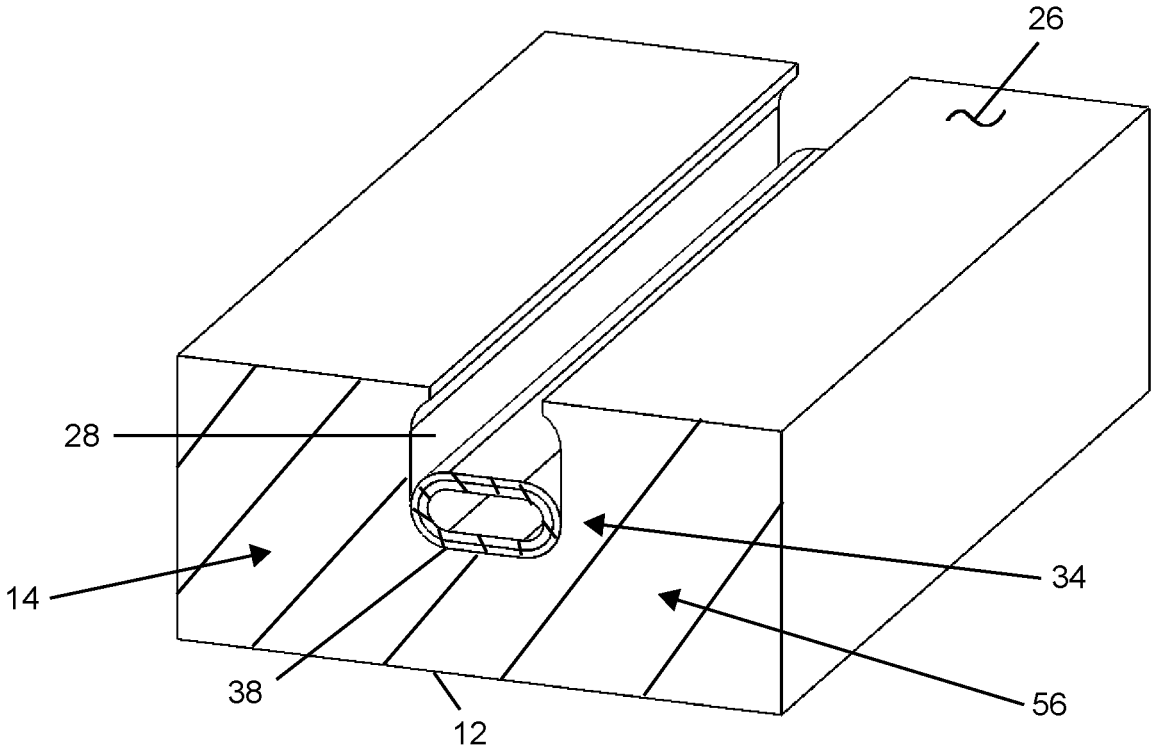
FIG. 3 is taken from region 3 of the heat spreader of FIG. 1.
Figure 4:
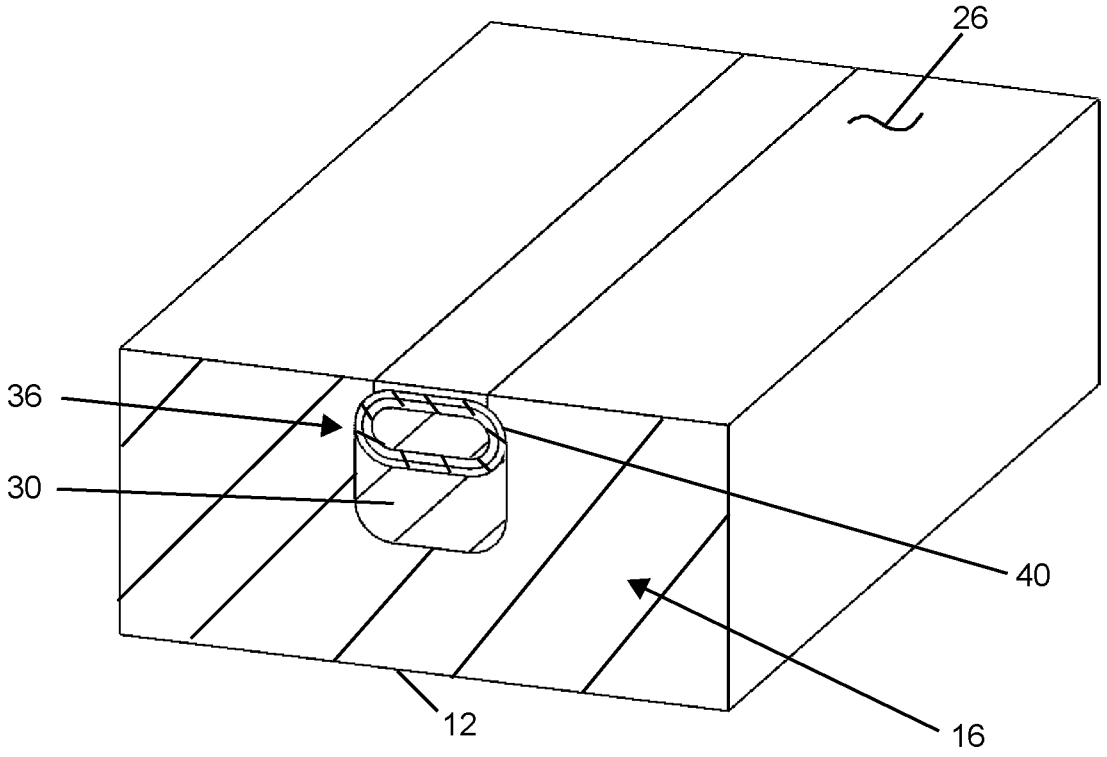
FIG. 4 is taken from region 4 of the heat spreader of FIG. 1.

As further shown in FIGS. 2-4, heat pipes 14, 16 are arranged and disposed to provide both an overlap or overlapping arrangement 54 and a nonoverlapping arrangement 56 in one or both of grooves 28, 30. For purposes herein in the context of FIG. 1, an overlapping arrangement is a first heat pipe, such as heat pipe 14 in contact or close proximity to a second heat pipe, such as heat pipe 16 within a body such as body 13 of a baseplate such as baseplate 12. That is, as shown in FIG. 2 which is taken from region 2 of FIG. 1, heat pipes 14, 16 are installed in multiple layers 34, 36 to achieve overlapping arrangement 54 inside of groove 28, while keeping heat pipes 14, 16 from floating, arising above, or otherwise protruding from surface 26 of baseplate 12 during soldering, applying epoxy, or other suitable assembly methods, as desired. Furthermore, as shown in FIG. 3 which is taken along line 3-3 of FIG. 1, heat pipe 14 is arranged and disposed to provide nonoverlapping arrangement 56 inside of groove 28 at layer 34, while keeping heat pipe 14 from floating, arising above, or otherwise protruding from surface 26 of baseplate 12 during assembly. Similarly to FIG. 3, such as shown in FIG. 4 which is taken along line 4-4 of FIG. 1, heat pipe 16 is arranged and disposed to provide nonoverlapping arrangement 56 inside of groove 30 at layer 36, while keeping heat pipe 16 from floating, arising above, or otherwise protruding from surface 26 of baseplate 12 during assembly. In one embodiment, the heat pipes may be arranged and disposed to define or form the overlapping arrangement or nonoverlapping arrangement at or adjacent to the intersection or junction of the intersecting grooves, although for purposes herein, such an embodiment is considered to provide both an overlapping arrangement and a nonoverlapping arrangement within the baseplate grooves.

As further shown in FIG. 2, each of heat pipes 14, 16 include a respective surrounding layer 38, 40 of envelope material that is initially annealed copper or other suitable conductive and malleable material. Heat pipe 14 positioned in bottom layer 34 is pressed into groove 28 using press tooling (not shown) which deforms heat pipe 14 to its final shape and work hardens the copper envelope material. Heat pipe 16 in top layer 36 is pressed into groove 28 and into contact with heat pipe 14 using a second set of press tooling (not shown) which deforms heat pipes 14, 16 to their final shapes. In one embodiment, one or both of layers 38, 40 or corresponding grooves have gaps sometimes referred to as "downcomers" permitting at least a partial or intermittent flow of epoxy/solder into the groove between overlapping heat pipes in order to improve heat transfer between the heat pipes and the groove(s). In one embodiment, solder or epoxy may be introduced in two steps, the first step being performed after inserting and pressing heat pipe 14 in lower layer 34 of groove 28, and the second step being performed after inserting and pressing heat pipe 16 in upper layer 36 of groove 28. In one embodiment, solder or epoxy may be introduced from either end of groove 28 after heat pipes 14, 16 have been installed and pressed into position and solder or epoxy has been applied over heat pipe 16. In one embodiment, solder or epoxy may be introduced from either end of groove 28 after heat pipes 14, 16 have been installed and pressed into position but prior to the application of solder or epoxy over heat pipe 16. In one embodiment, epoxy may be applied prior to inserting and pressing heat pipe 14 in position, as well as prior to and subsequent to inserting and pressing heat pipe 16 in position. In one embodiment, at least a portion of heat pipe 18 is positioned in layer 34. In one embodiment, at least a portion of heat pipe 18 may be positioned in layer 36. In one embodiment, a portion of heat pipe 16 may be positioned in layer 34 (e.g., if the depth of groove 30 is sufficient).

As further shown in FIG. 2, a single thermally conductive layer 44 such as epoxy or solder is used to embed layers 34, 36 of heat pipes 14, 16 into baseplate 12. The solder operation would occur after the pressing operation. Epoxy would be applied during the pressing operation.

The sequence of pressing operations is critical to ensure that after pressing, both sets of heat pipes achieve their final deformed shape without damaging either set which could significantly impact heat pipe heat transport capacity.

Figure 5:
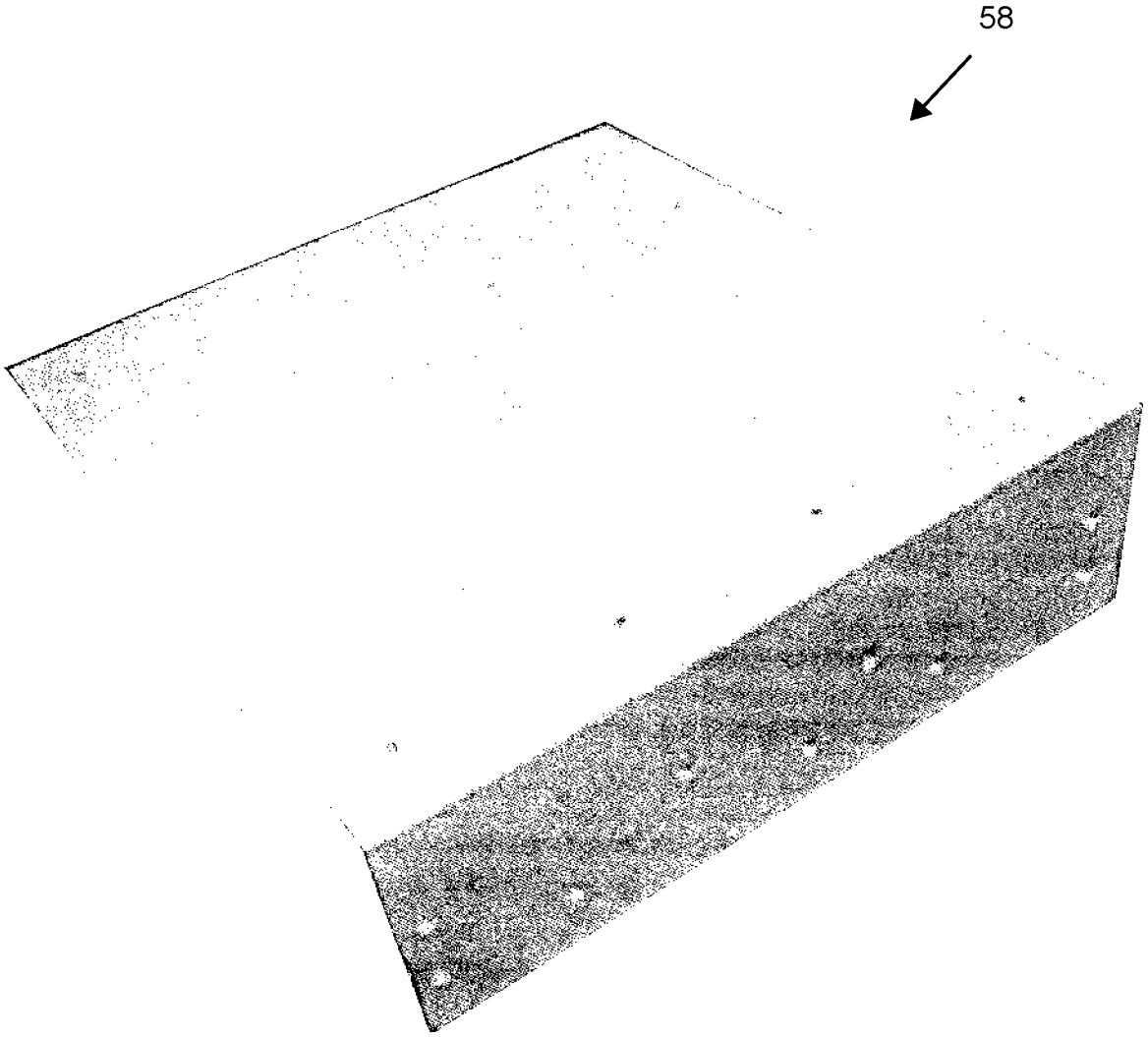
FIGS. 5-6 are different upper perspective views of an exemplary heat spreader, with FIG. 6 including a partial cutaway.
Figure 6:
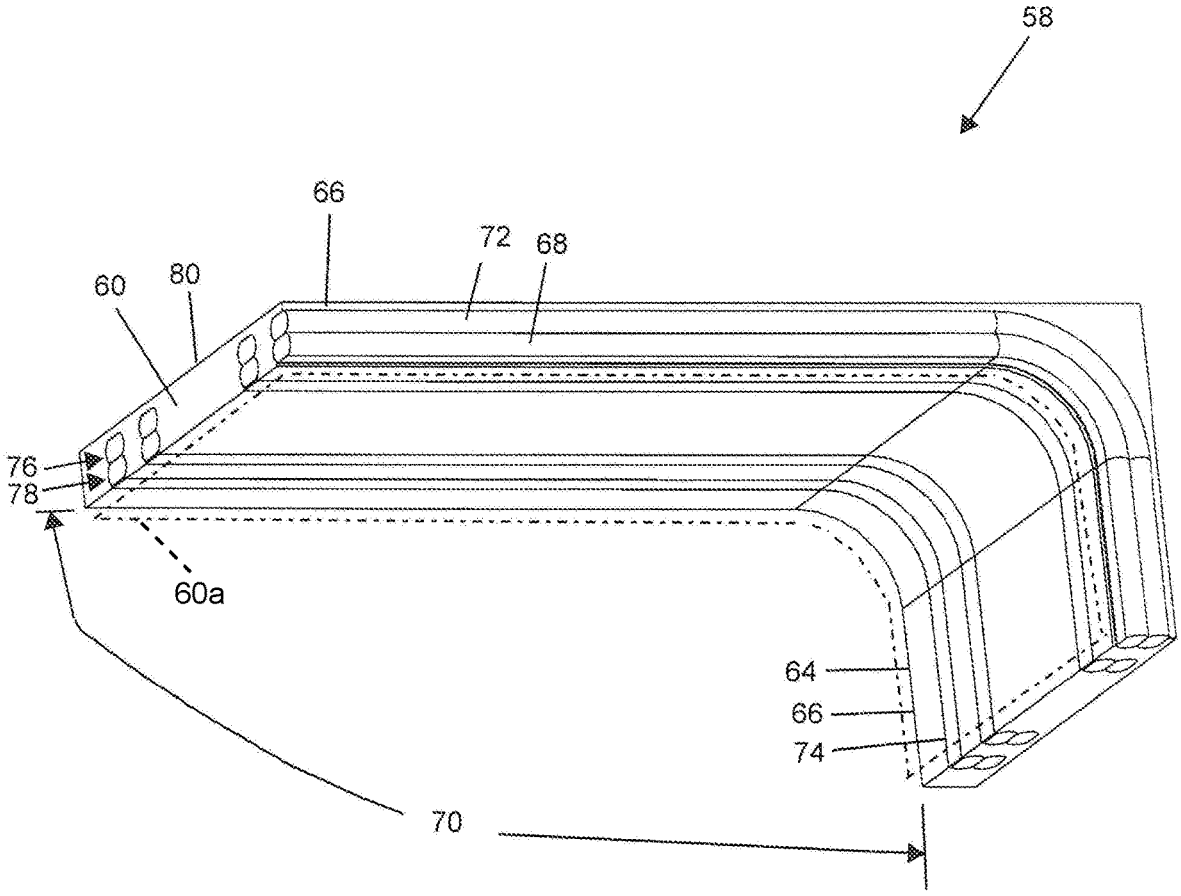

FIGS. 5 and 6 collectively show an exemplary heat spreader 58 in which heat pipes are bent around a corner. For example, heat spreader 58 includes a body 60 that is secured to an extension 62 including a body 64 which extends at an angle 70 relative to body 60. For purposes of clarity, a body portion 60*a* of body 60 is partially shown extending away from surface 80. As shown, angle 70 is 90 degrees. Body 60 includes a groove 66 formed in surface 80 for receiving a portion of heat pipe 68. In one embodiment, groove 66 is only accessible from surface 80. In one embodiment, groove 66 is only accessible from the surface associated with body portion 60*a*. Extension 62 includes a groove 74 for receiving the remaining portion of heat pipe 68 that has been bent 90 degrees relative to the portion of heat pipe 68 received by groove 66. In one embodiment, angle 70 may be less than 90 degrees, 90 degrees or less, or greater than 90 degrees. Optionally, an additional heat pipe 72 may be added such that heat pipe 72 is positioned at a layer 76 forming an overlapping arrangement with heat pipe 68 positioned at layer 78. In one embodiment, only heat pipe 68 is bent or extends between body 60 and body 64 of extension 62. In this embodiment, heat pipe 72, which is closer to surface 80 of heat spreader 58 terminates prior to the bend (i.e., heat pipe 72 is straight). In one embodiment, heat pipe 72 is bent or extends between body 60 and body 64 of extension 62, heat pipe 68, which is comparatively further from surface 80 of heat spreader 58 than heat pipe 72, may also extend between body 60 and body 64 of extension 62 and form an overlapping arrangement, or terminate prior to the bend (i.e., heat pipe 68 is straight).

Figure 7:
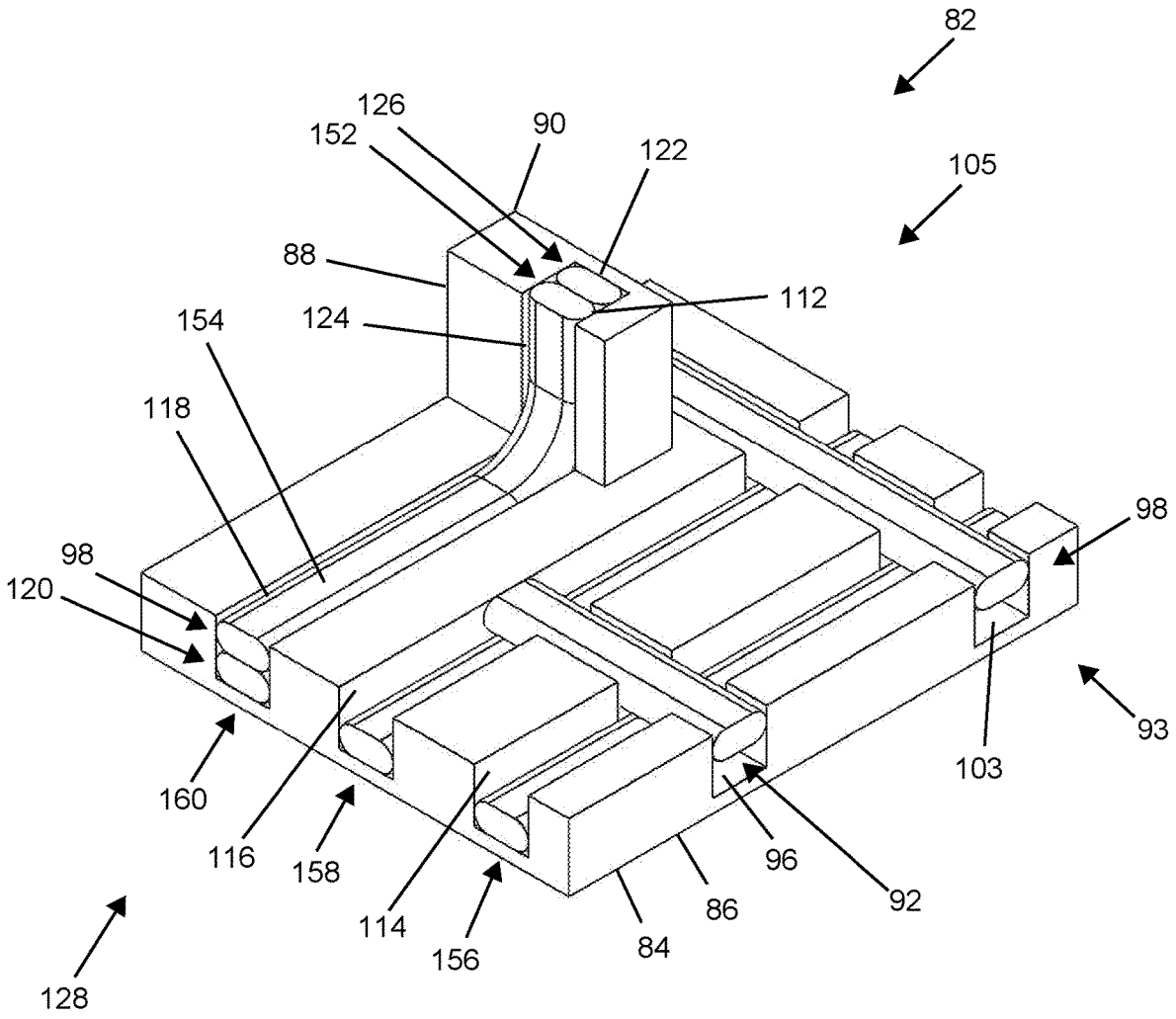
FIG. 7 is an upper perspective view of an exemplary heat spreader.

FIG. 7 shows an exemplary heat spreader 82 including a baseplate 84 having a body 86 and an extension 88 secured to baseplate 84, extension 88 having a body 90 extending away from baseplate 84. As shown, a heat pipe 92 is received in a groove 96 in a layer 98. A heat pipe 93 is received in a groove 103 in a layer 98. Both groove 96 and groove 103 extend in the same direction. As further shown, heat pipes 156, 158, 160 are received by respective grooves 114, 116, 118 formed in baseplate 84 in a layer 120, each of grooves 114, 116, 118 extending in the same direction. Heat pipe 160 further includes a heat pipe portion 122 that is interconnected to heat pipe 160, heat pipe portion 122 received in groove 124 formed in extension 88 in a layer 126. Groove 124 of extension 88 further receives a heat pipe portion 112 in a layer 152 in an overlapping arrangement with heat pipe portion 122, which heat pipe portion 112 is interconnected to heat a pipe portion 154 received in groove 118 formed in baseplate 84.

Collectively, as shown in FIG. 7, heat pipes 92, 93, 156, 158, 160 of a heat pipe network 105 received in grooves 96, 102, 114, 116, 118 form or define a criss-cross arrangement 128, providing effective thermal communication. A criss-cross arrangement is a pattern formed by a plurality of crossing paths (more specifically, for purposes herein, the paths being heat pipe portions or separate heat pipes of a heat pipe network received in grooves).

Figure 7A:
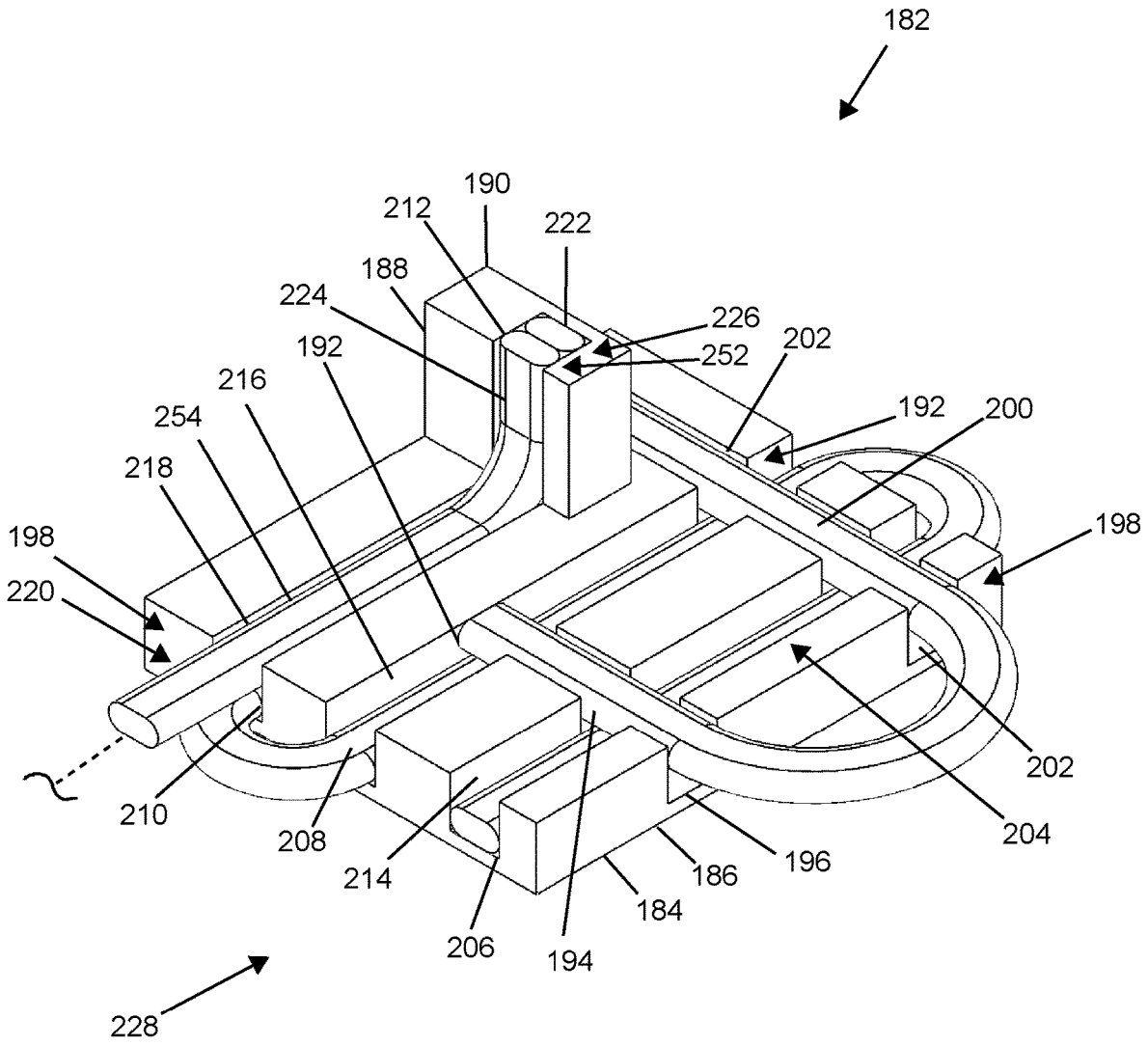
FIG. 7A is an upper perspective view of an exemplary heat spreader.

FIG. 7A shows an exemplary heat spreader 182 including a baseplate 184 having a body 186 and an extension 188 secured to baseplate 184, extension 188 having a body 190 extending away from baseplate 184. As shown, a heat pipe 192 includes a heat pipe portion 194 received in a groove 196 in a layer 198 that extends to a heat pipe portion 200 received in groove 202 in a layer 198. Both groove 196 and groove 202 extend in the same direction. As further shown, a heat pipe 204 includes interconnected heat pipe portions 206, 208, 210 received by respective grooves 214, 216, 218 formed in baseplate 184 in a layer 220, each of grooves 214, 216, 218 extending in the same direction. Heat pipe 204 further includes a heat pipe portion 222 that is interconnected to heat pipe portion 210, heat pipe portion 222 received in groove 224 formed in extension 188 in a layer 226. Groove 224 of extension 188 further receives a heat pipe portion 212 in a layer 252 in an overlapping arrangement with heat pipe portion 222, which heat pipe portion 212 is interconnected to heat a pipe portion 254 received in groove 218 formed in baseplate 184. In one embodiment (not shown), heat pipe portion 254 is interconnected to heat pipe portion 200 of heat pipe 192.

Figure 8:
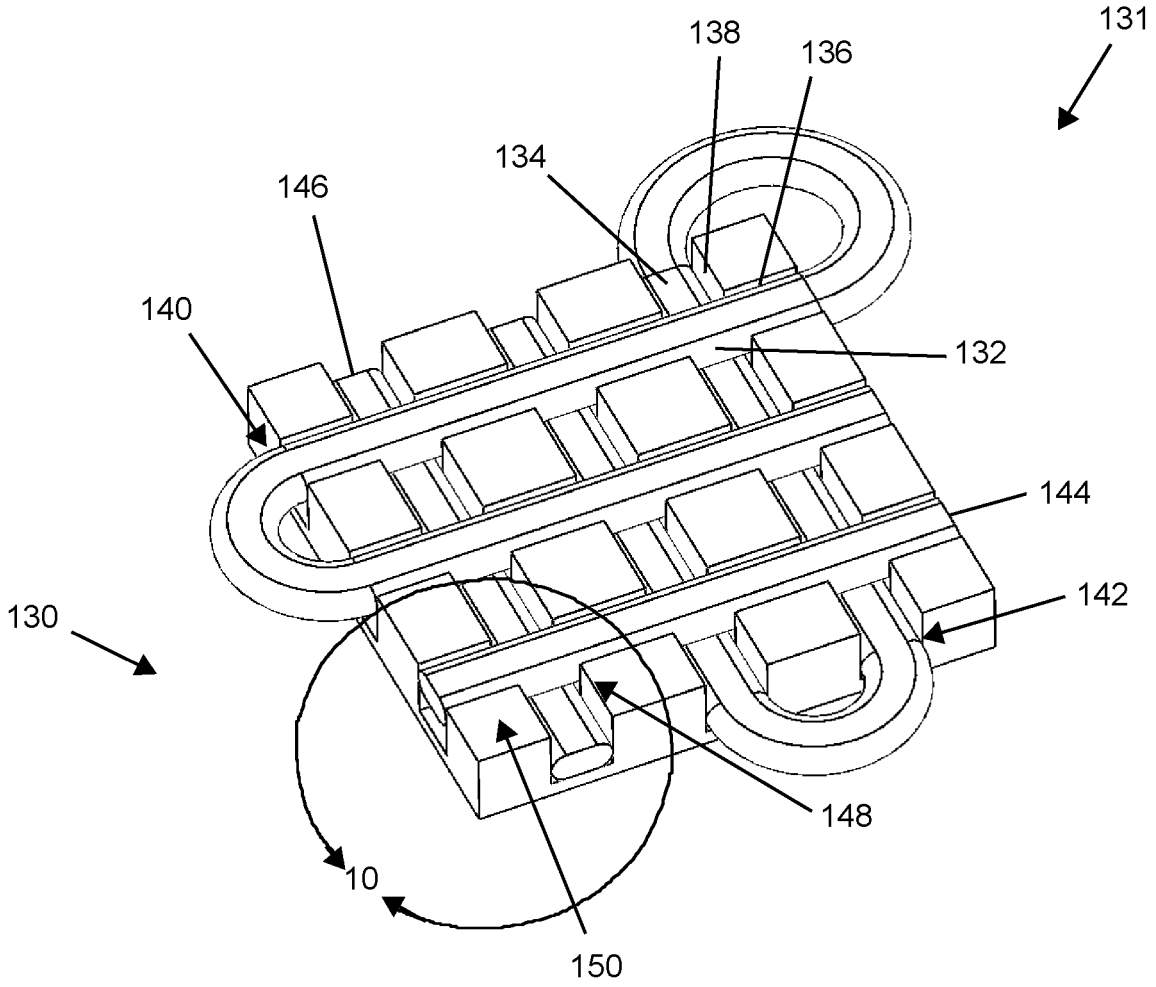
FIG. 8 is an upper perspective view of an exemplary heat spreader.
Figure 9:
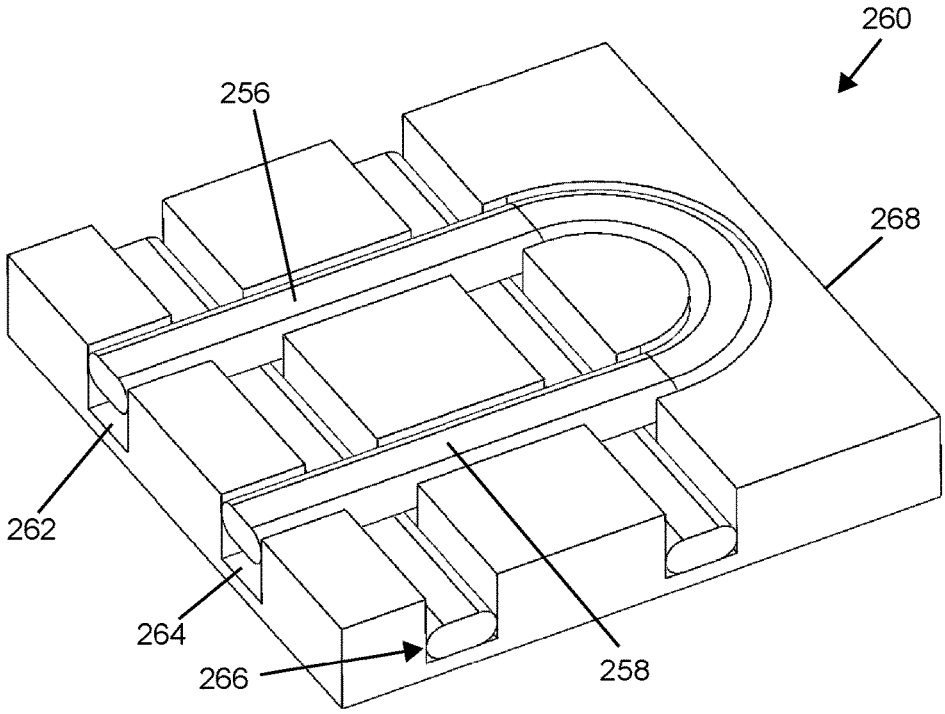
FIG. 9 is an upper perspective view of an exemplary heat spreader.
Figure 10:
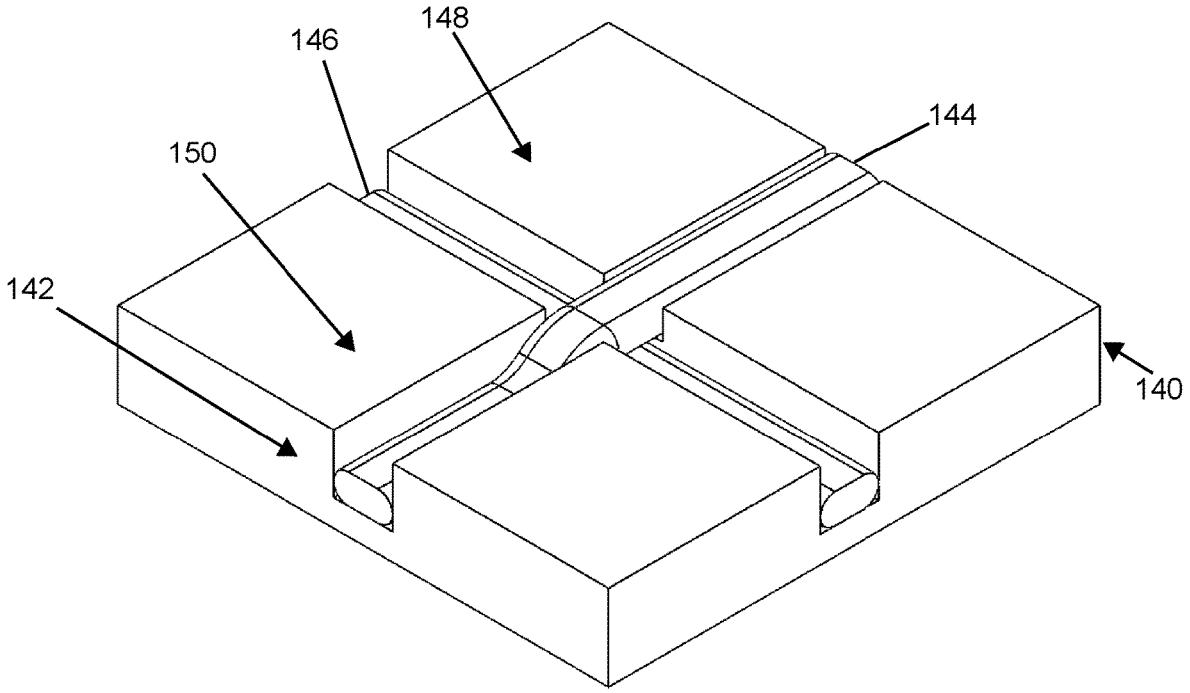
FIG. 10 is an upper perspective of a portion of an exemplary heat spreader view taken from region 10 of FIG. 8.

Collectively, as shown in FIG. 7A, heat pipes 192, 204 (and corresponding heat pipe portions) received in grooves 196, 202, 214, 216, 218 form or define a criss-cross arrangement 228. A criss-cross arrangement is a pattern formed by a plurality of crossing paths (more specifically, for purposes herein, the paths being heat pipe portions or separate heat pipes of a heat pipe network received in grooves). In one embodiment employing a criss-cross arrangement, the grooves are uniformly spaced (see FIG. 8), extending in either mutually parallel or perpendicular directions, such as defining a tic-tac-toe arrangement 130 or grid. In one embodiment employing a criss-cross arrangement, one or more grooves are not uniformly spaced (see FIG. 7), with at least one groove extending in a non-parallel nor perpendicular direction relative to another groove. In one embodiment, at least two grooves receiving a corresponding heat pipe portion of a heat pipe extends in the same direction, with each heat pipe portion being received in the same groove layer, such as shown in FIG. 9 with heat pipe portions 256, 258 of heat pipe 260 received by respective grooves 262, 264 at layer 266 of baseplate 268. In one embodiment, at least one groove receiving a heat pipe portion of a heat pipe extends in a different direction, such as shown in FIG. 8 having a criss-cross arrangement 131 with interconnected heat pipe portions 132, 134 received in respective grooves 136, 138 at layers 140, 142. In one embodiment, it is appreciated that heat pipe portions of a heat pipe extending in different directions can interconnect in the same layer, which would occur if the ends of heat pipe portions 144, 146 positioned in layer 142 of FIG. 10 were interconnected. In one embodiment, at least one groove receiving a heat pipe portion of a heat pipe extends in a different direction, such as shown in FIG. 8 having a criss-cross arrangement 131 with heat pipe portions 132, 134 received in respective grooves 136, 138 in different respective layers 140, 142. In one embodiment, as shown in FIG. 8, heat pipe portion 144 is positioned in layer 140 at both an overlapping arrangement 148 and a non-overlapping arrangement 150. However, in another embodiment, such as shown in FIG. 10, which is taken from region 10 of FIG. 8, prior to and including overlapping position 148, heat pipe portion 144 is positioned in layer 140. However, subsequent to heat pipe portion 144 being disposed or positioned in an overlapping nonoverlapping arrangement 150, heat pipe portion 144 transitions from or extends between layer 140 and layer 142. Similarly, in one embodiment, heat pipe portion 146 may extend between layer 140 and layer 142 subsequent to heat pipe portion 146 being disposed or positioned in an overlapping nonoverlapping arrangement 150. Although the layer transition of heat pipe 144 shown in FIG. 10 occurs entirely within one straight portion of a groove, a layer transition of a heat pipe portion occurring at an intersection between and/or adjacent to the intersection or junction of the intersecting grooves while the heat pipe extends from one groove and into another groove is contemplated by the invention.

As a result of the criss-cross arrangements, the effective thermal conductivity of the heat spreader is increased to a level approaching a vapor chamber, spreading heat in at least two dimensions, but at significantly reduced fabrication cost.

Figure 11:
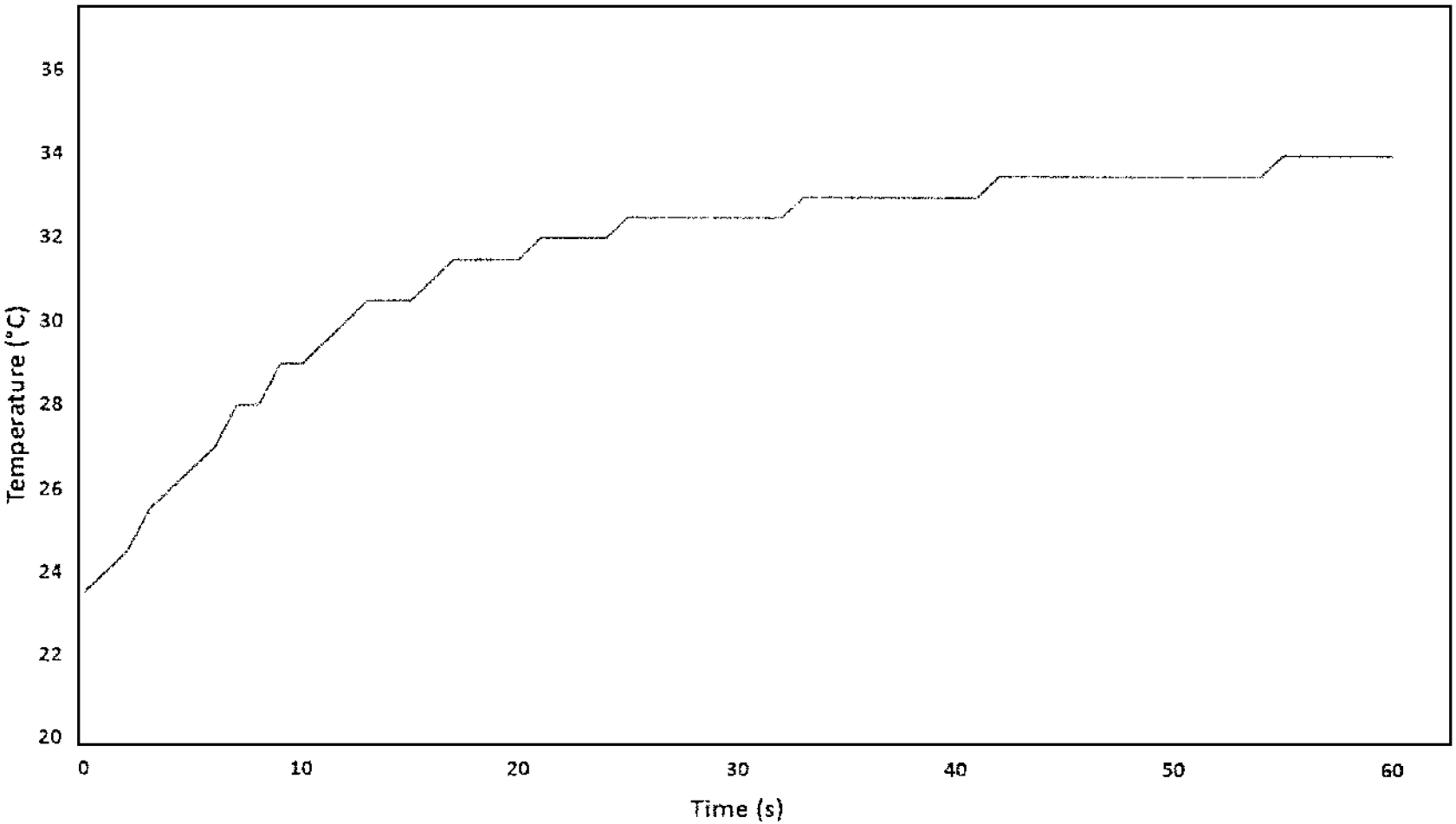
FIG. 11 is a graphical representation of a simulated temperature versus time scenario.
Figure 12:
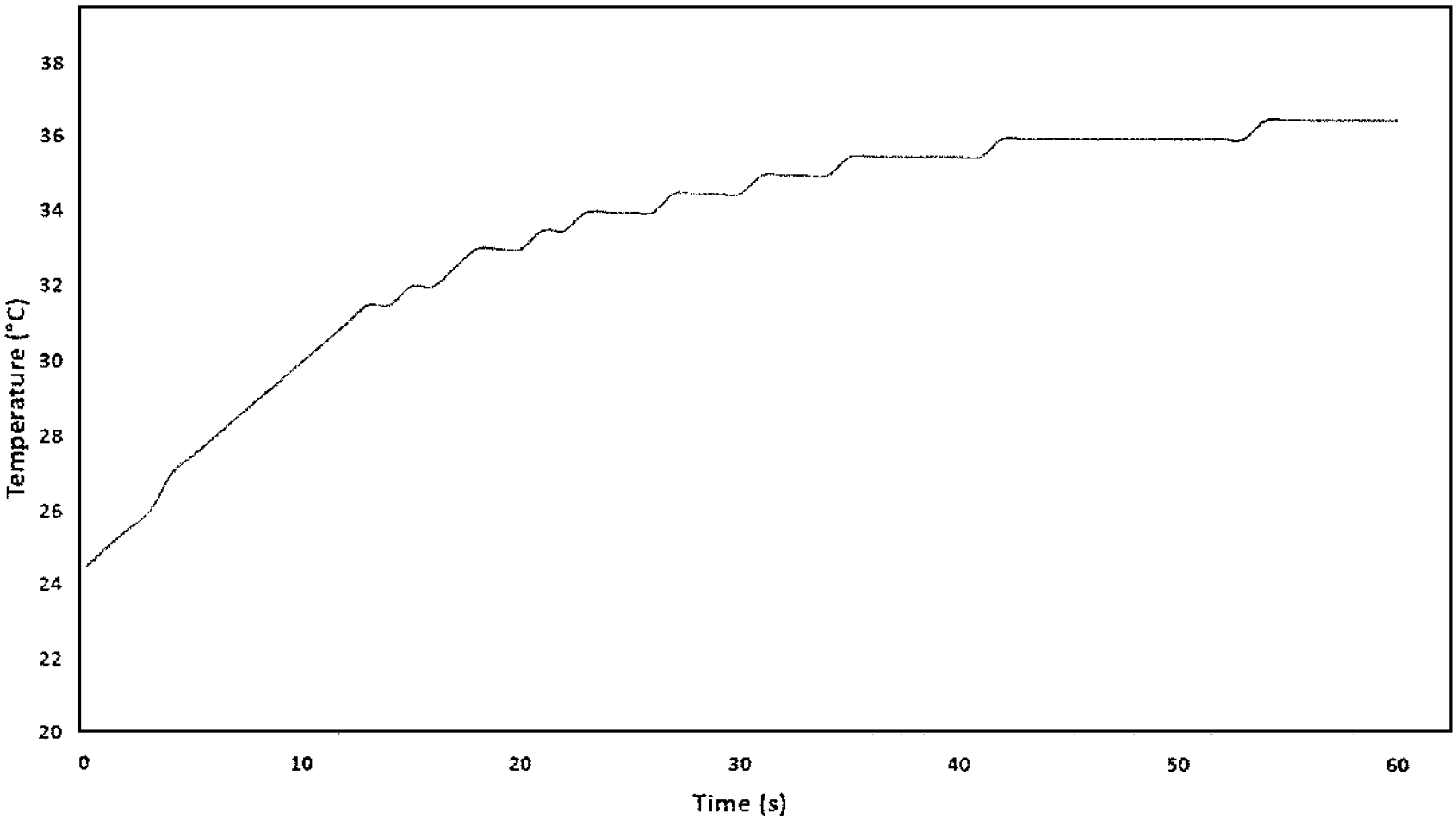
FIG. 12 is a graphical representation of a simulated temperature versus time scenario.

A prototype heat sink was fabricated and tested while undergoing 6*g* acceleration in a centrifuge for the arrangement shown in FIG. 1. A single heat load was applied and temperature was monitored for 60 seconds. FIG. 11 and FIG. 12. graphically show plots of temperature vs. time for the two worst case acceleration scenarios, i.e., acceleration forces applied in respective opposite directions parallel to direction 24 of heat pipe 14 and groove 28 of FIG. 1. Prior to testing, a computational fluid dynamics model was used to predict the final temperature and in both cases the results were comparable to the model prediction. That is, in one direction, as shown in FIG. 11, a 10.5° C. increase was measured, while a 10° C. increase was predicted by the computational fluid dynamics model. In the other direction, as shown in FIG. 12, a 12° C. increase was measured, while a 14° C. increase was predicted by the computational fluid dynamics model.

It is to be understood the number of heat pipes in a heat spreader may be greater than three.

It is to be understood that although the heat pipes and heat pipe portions are not shown extending past the ends of their corresponding baseplates and extensions, the present invention is not so limited, and contemplates extending the heat pipes and heat pipe portions past the ends of their corresponding baseplates and extensions, such as to a remote heat source or heat sink.

It is to be understood that the various descriptions of the embodiments disclosed herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

In the present disclosure, other than where otherwise indicated, all numbers expressing quantities or characteristics are to be understood as being prefaced and modified in all instances by the term "about." Accordingly, unless indicated to the contrary, any numerical parameters set forth in the following description may vary depending on the desired properties one seeks to obtain in the embodiments according to the present disclosure. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicant reserves the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. sctn. 112, first paragraph, and 35 U.S.C. sctn. 132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

Any patent, publication, or other disclosure material, in whole or in part, that is said to be incorporated by reference herein, is incorporated herein in its entirety, but only to the extent that the incorporated material does not conflict with existing definitions, statements, or other disclosure material expressly set forth in this disclosure. As such, and to the extent necessary, the express disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. An apparatus for dissipating thermal energy, comprising:

a baseplate including a first body having a first groove and a second groove intersecting one another, the first groove and the second groove formed in and only accessible from a first side of the baseplate; and a first heat pipe and a second heat pipe arranged and disposed to provide both an overlapping arrangement defined by the first heat pipe and the second heat pipe positioned on top of one another within at least one of the first groove and the second groove of the baseplate and a nonoverlapping arrangement within the first groove and the second groove of the baseplate.

2. The apparatus of claim 1, wherein at least a portion of the first groove extends in a first direction, and at least a portion of the second groove extends in a second direction;

wherein the first direction subtends a first angle with the second direction.

3. The apparatus of claim 2, wherein the first angle is 90 degrees or less.

4. The apparatus of claim 2, wherein the first angle is greater than 90 degrees.

5. The apparatus of claim 1, wherein the first heat pipe is disposed in a first layer in at least one of the first groove and the second groove, and the second heat pipe is disposed in a second layer in at least one of the first groove and the second groove.

6. The apparatus of claim 1, wherein the first heat pipe extends between a first layer and a second layer in at least one of the first groove and the second groove.

7. The apparatus of claim 1, wherein the second heat pipe extends between a first layer and a second layer in at least one of the first groove and the second groove.

8. The apparatus of claim 6, wherein the second heat pipe extends between the first layer and the second layer in at least one of the first groove and the second groove.

9. The apparatus of claim 1, wherein the baseplate includes an extension having a second body extending away from the first body, the extension having at least a first groove formed therein.

10. The apparatus of claim 1, wherein the first heat pipe and the second heat pipe form a criss-cross arrangement.

11. A method of making an apparatus for dissipating thermal energy, comprising:

providing a baseplate including a first body;

forming a first groove and a second groove in a first side of the baseplate, the first groove and the second groove intersecting one another, and the first groove and the second groove only being accessible from the first side of the baseplate; and positioning a first heat pipe and a second heat pipe to provide both an overlapping arrangement that is positioned on top of one another within at least one of the first groove and the second groove of the baseplate and a nonoverlapping arrangement within the first groove and the second groove of the baseplate.

12. The method of claim 11, wherein forming the first groove and the second groove results in at least a portion of the first groove extending in a first direction, and at least a portion of the second groove extending in a second direction;

wherein the first direction subtends a first angle with the second direction.

13. The method of claim 11, wherein positioning the first heat pipe and the second heat pipe results in the first heat pipe being disposed in a first layer in at least one of the first groove and the second groove, and the second heat pipe being disposed in a second layer in at least one of the first groove and the second groove.

14. The method of claim 11, wherein positioning the first heat pipe and the second heat pipe results in the first heat pipe extending between a first layer and a second layer in at least one of the first groove and the second groove.

15. The method of claim 11, wherein positioning the first heat pipe and the second heat pipe results in the second heat pipe extending between a first layer and a second layer in at least one of the first groove and the second groove.

16. The method of claim 14, wherein positioning the first heat pipe and the second heat pipe results in the second heat pipe extending between the first layer and the second layer in at least one of the first groove and the second groove.

17. An apparatus for dissipating thermal energy comprising:

a baseplate including a body having a first groove and a noncoincident second groove each intersecting a third groove;

wherein the first groove, the second groove, and the third groove each formed in and only accessible from a first side of the baseplate; and a first heat pipe at least partially disposed in the first groove, a second heat pipe at least partially disposed in the second groove, and a third heat pipe at least partially disposed in the third groove;

wherein the first heat pipe, the second heat pipe and the third heat pipe each arranged and disposed to provide both an overlapping arrangement that is positioned on top of one another within at least one of the first groove, the second groove, and the third groove of the baseplate and a nonoverlapping arrangement within at least one of the first groove, the second groove, and the third groove of the baseplate.

18. The apparatus of claim 17, wherein at least a portion of the first groove extends in a first direction, at least a portion of the second groove extends in a second direction, and at least a portion of the third groove extends in the third direction;

wherein the first direction subtends a first angle with the second direction, the first direction subtends a second angle with the third direction, and the second direction subtends a third angle with the third direction.

19. The apparatus of claim 18, wherein at least one of the first angle, the second angle, and the third angle is 90 degrees or less.

20. The apparatus of claim 18, wherein at least one of the first angle, the second angle, the third angle is greater than 90 degrees.

* * * * *